United States Patent [19]

Helms, Jr.

[11] Patent Number: 4,667,965

[45] Date of Patent: May 26, 1987

[54] GAME WITH PEGS RANDOMLY MOVED ON BOARD TO STRETCH AN ELASTIC BAND

[75] Inventor: Robert L. Helms, Jr., Citra, Fla.

[73] Assignee: O-Board, Inc., Citra, Fla.

[21] Appl. No.: 752,624

[22] Filed: Jul. 8, 1985

[51] Int. Cl.[4] ..... A63F 3/00

[52] U.S. Cl. ..... 273/243; 273/282

[58] Field of Search ..... 273/1 R, 1 G, 236, 243, 273/248, 249, 282 R, 282 C; 434/83

[56] References Cited

U.S. PATENT DOCUMENTS

| | | | |
|---|---|---|---|
| 2,984,488 | 5/1961 | Kirchner | 434/83 X |
| 3,419,971 | 1/1969 | Ribken | 434/88 |
| 3,672,679 | 6/1972 | Burns | 273/282 R X |

*Primary Examiner*—Anton O. Oechsle

*Attorney, Agent, or Firm*—Julian C. Renfro

[57] ABSTRACT

An elongate game board for use by at least two players, with the board having a number of holes disposed in an equally spaced manner in each of a series of essentially parallel columns, which columns extend for a substantial portion of the length of the board. The holes typically are of a depth sufficient to receive therein a peg representing each player. Elastic band suspension devices are located adjacent one end of the game board, around which an elastic band is mounted, with the elastic band having sufficient elasticity as to permit it to be stretched around two or more pegs placed in holes of respective columns. The elastic band continues to be stretched to a greater and greater extent as the players' pegs are moved further down their respective columns in a first direction, with the loser in each phase of the game being that person causing the elastic band to break while he or she is endeavoring to move his or her peg to a hole further away from the elastic band suspension means. A second set of elastic band suspension devices may be located at the second end of the board, so that elastic bands of substantial length may be used in the game. In this latter instance, the pegs may be moved in the return direction after the still unbroken elastic band has been wrapped around the second set of suspension devices.

5 Claims, 5 Drawing Figures

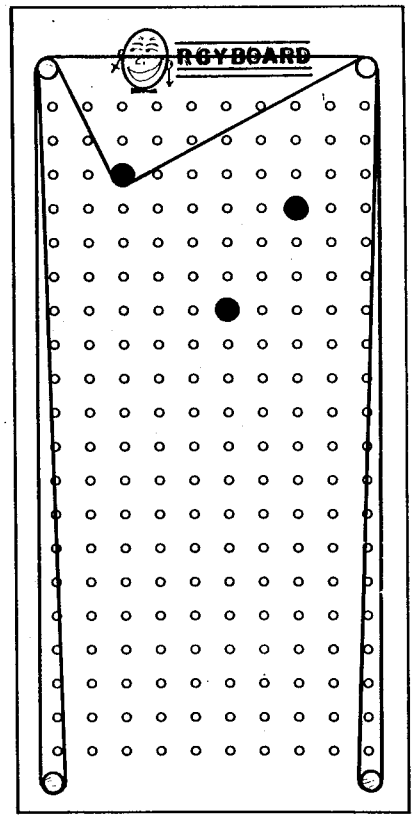
FIG. 2
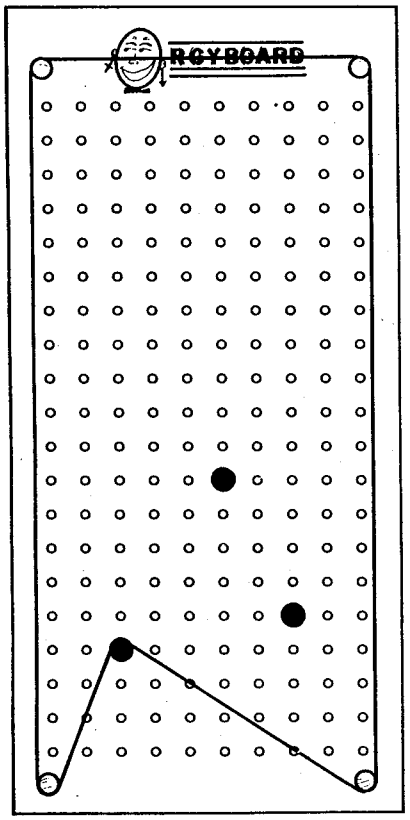
FIG. 3
FIG. 4
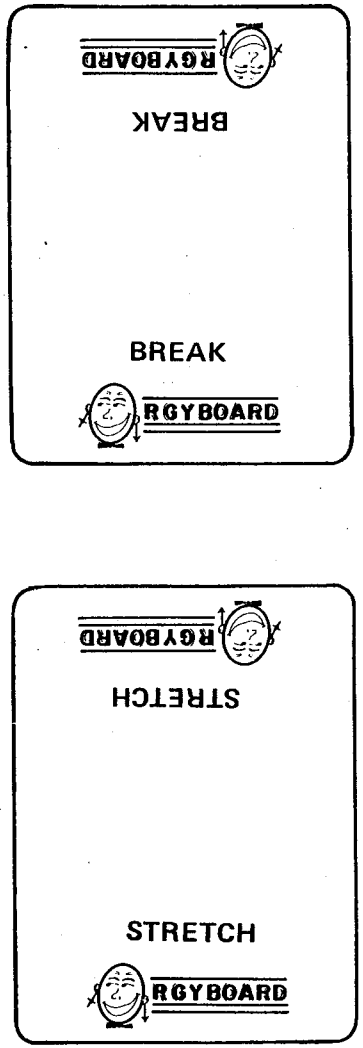
FIG. 5

GAME WITH PEGS RANDOMLY MOVED ON BOARD TO STRETCH AN ELASTIC BAND

BACKGROUND OF THE INVENTION

In the past a number of game boards have been provided that were designed to be used in connection with pegs. In some instances, the pegs were used for score keeping, but in the Cooper U.S. Pat. No. 3,608,903, pegs were used in connection with a box into which balloons are placed, with it being an object of the game for each child to try to drive a peg or nail into the box without bursting a balloon.

Still another type of game utilizing pegs is the Shoptaugh U.S. Pat. No. 3,834,708, wherein a game board is provided with holes of differing depths, and the players are provided with pegs of different lengths, with it being the object of the game for each player to get his pieces in a tight cluster, with the pieces extending the same height above the board.

It was in an effort to provide a game board associated with a game of considerable interest to adults that the present invention was created.

SUMMARY OF THE INVENTION

In accordance with this invention, I provide an elongate game board for use by at least two players, with the game board comprising a number of holes disposed in an equally spaced manner, in each of a series of essentially parallel columns. These columns extend for a substantial portion of the length of the board, with the holes each being of a depth sufficient to receive the peg that has been assigned to, or that represents each player.

Elastic band suspension means are provided at one end of the elongate game board, around which an elastic band is mounted, with such elastic band having sufficient elasticity as to permit it also to be stretched around two or more pegs placed in holes of respective columns of the board. Each player takes a turn at drawing a card from a small stack of "stretch" cards, with each such card specifying how many holes his peg must be moved, with the peg movements along respective columns serving to increase the tension in the elastic band. In addition to specifying how many holes a peg must be moved, these cards also specify an activity with which the player must comply, such as having to scratch another player's back, make a short speech, or the like.

It is to be realized that the elastic band is continuing to be stretched to a greater and greater extent as the players' pegs are moved further down their respective columns, with the loser in each phase of the game being that person causing the elastic band to break while he or she is endeavoring to move his or her peg to a hole spaced further away from the elastic band suspension means.

It is always possible that the elastic band will not break by the time that a peg has moved all the way to the far end of the board, so for that reason I may also provide an elastic band suspension means mouunted at the opposite end of the board. Therefore, the player whose peg reaches the far end of the board without breaking the elastic band must wrap the band around the second elastic band suspension means, and then around the peg or pegs starting on the return trip along the respective columns of holes.

A penalty may be associated with each person causing the elastic band to break while he or she is endeavoring to move his or her peg in accordance with the card drawn. An additional stack of cards, known as "break" cards, are provided, with one of such cards having to be drawn at the time a player causes the elastic band to break. A break card typically specifies a more burdensome penalty than those penalties provided by the first stack of cards, thus providing a real incentive for each person to avoid breaking the elastic band while taking his or her turn. Such penalty may be one of such a nature as to cause some embarrassment, or having to try to answer a question involving general or specific knowledge.

It is therefore a primary object of my invention to provide a board game of inexpensive construction that provides great entertainment for all the players thereof.

It is another object of my invention to provide a game board of elongate configuration, having a number of holes disposed in an equally spaced manner in each of a series of essentially parallel columns, in combination with an elastic band suspension means located at one or both ends of the board.

It is still another object of my invention to provide a game board utilizing an elastic band stretched around a pair of posts, with each player taking a turn at moving his peg in a manner that further stretches the elastic band, while he or she is striving to prevent breakage of the elastic band.

It is yet still another object to provide a game board used with a game providing considerable entertainment for a group of players, typically a mixed group of males and females.

These and other objects, features and advantages will be more apparent upon a study of the appended drawings.

BRIEF DESCRIPTION OF DRAWINGS

FIG. 2 is an example of the stretch of the elastic band around the suspension means at the beginning or first end of the board, and in this instance being in contact with two of the pegs during play of the game;

FIG. 3 is an example of the elastic band having stretched far enough during play as to also extend around the suspension means located at the opposite or second end of the board, with one of the pegs in play being in the process of starting back toward the beginning or first end of the board;

FIG. 4 is an example of the events that may transpire if an elastic band of substantial length is used, for in this instance, one of the pegs has traveled to the second end of the board and back, and is now in the process of making a second start from the first end of the board; and FIG. 5 is a view of the stacks of stretch cards and break cards that may be used during play of this game.

DETAILED DESCRIPTION

Figure 1:
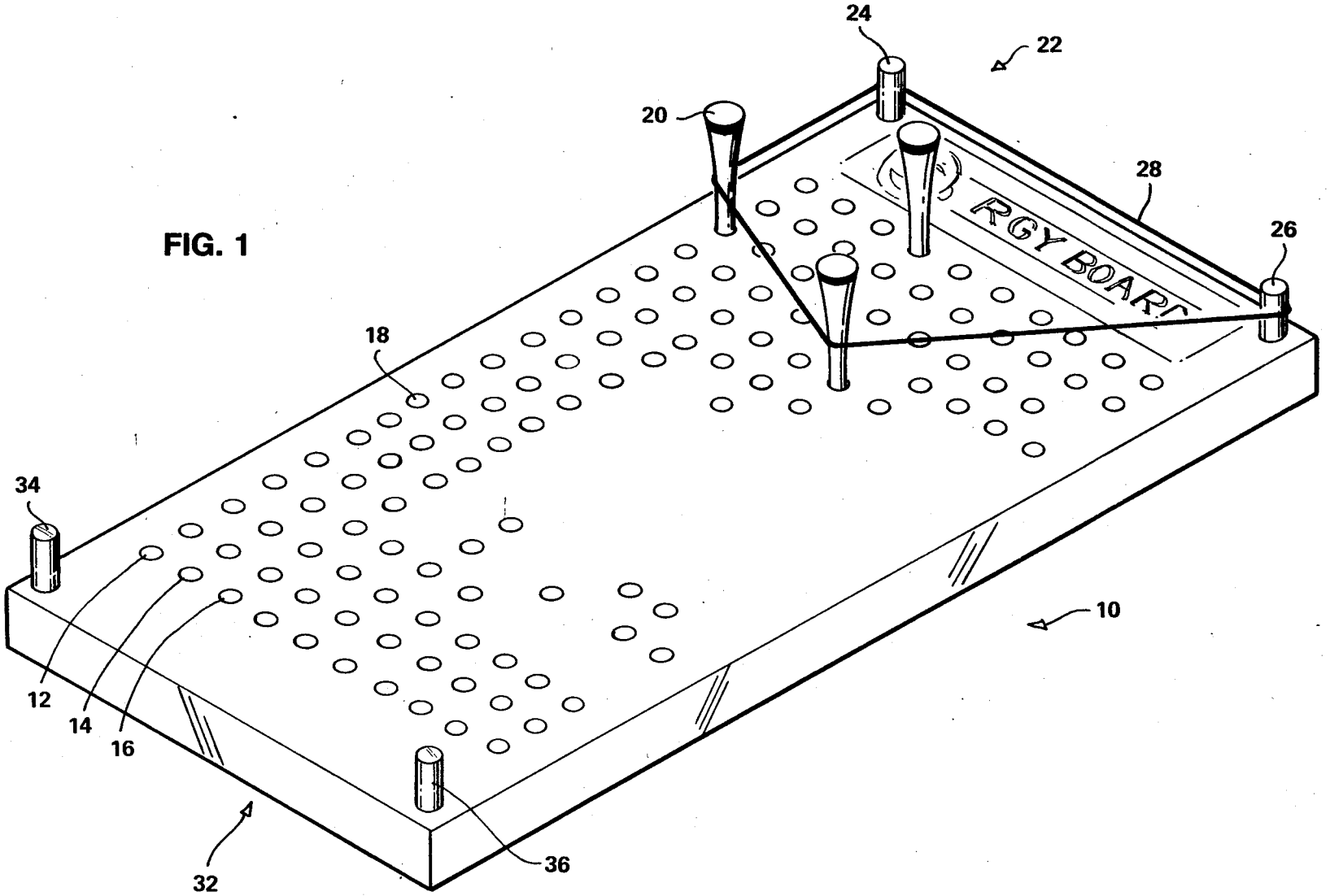
FIG. 1 is a view of a preferred embodiment of my novel game board, revealing a typical array of pegs as well as an elastic band stretched around the elastic band suspension means located at the beginning or first end of the game board, with the elastic band also being in contact with two of the pegs.

Turning to FIG. 1, it will there be seen that I have provided an elongate game board 10 having a number of holes disposed in an equally spaced manner in each of a series of essentially parallel columns, such as columns 12, 14, 16, and the like. These columns extend for a substantial portion of the length of the board, with each of the individual holes 18 being of a depth sufficient to receive therein, a peg 20 representing each player. The peg 20 can be in the nature of a golf tee.

Adjacent what I may regard as the beginning or first end of the game board I provide an elastic band suspension means 22, this taking the form of a pair of posts 24 and 26 mounted at opposite corners at the same end of the elongate game board. Extending between the posts 24 and 26 is an elastic band 28, also known as a rubber band, that has sufficient elasticity as to permit it being stretched around these posts as well as around two or more pegs in the manner shown in FIG. 1 without breaking.

However, it may be desirable for the elastic band 28 to be selected so as not to stretch beyond a length corresponding to the length of the game board, for it is desired for the elastic band to break while one person is taking his or her turn at moving his or her peg, with the foremost peg of the group being at all times in contact with the elastic band.

Each card of a first stack of cards, known as "stretch" cards, contains thereon a number indicating to the player drawing the card, the number of holes he or she must move his or her peg while in contact with the elastic band. Each of these cards may also contain a request for that player to perform a simple obligation or task, such as having to scratch the back of another player, make a short speech, or the like.

It is to be realized that a player does not comply with rules of the game by merely moving his peg from its present position for the number of holes called for by the card he draws. Rather, the player must first bring his or her peg up into contact with the elastic band before counting the number of holes the peg is to be moved. This rule removes the likelihood that the frontrunner in each instance will be the one to break the elastic band.

From the elastic band having been chosen carefully beforehand, the band may be of such length as to be expected to break during the time that one of the players is endeavoring to move his or her peg in compliance with the number contained on the card that he or she drew. As a penalty for causing the elastic band to break, that player must draw a card from a stack of cards called "break cards", with the break cards each setting forth an obligation such as having to shine the shoes of the other player, having to make a speech on a particular subject, or other such task somewhat more burdensome or embarrassing than the previous tasks. It should be quite apparent from this that the break cards should be chosen in accordance with the gender and age group of the players.

Another option is for the break cards to contain questions in the general nature of those to be found in a "trivial pursuit" game, with this of course giving each player causing the elastic band to break the chance to show off his or her knowledge.

It is always possible that the elastic band will be of such nature or length as to be able to stretch so far as not to break by the time that one or more pegs have reached holes located on the far end of the elongate board 10. Because of this, I prefer to provide a second elastic band suspension means 32 at the far end of the board, that is, the end remote from the first suspension means 22. This may also be referred to as the second end of the board. The elastic band suspension means 32 located at the second end may involve the use of posts 34 and 36.

As a result of this latter inclusion, it is readily possible for the elastic band to also be stretched around the posts of the second elastic band suspension means, and then around the player's pegs as they start in their designated columns back toward the first end of the board.

It is to be emphasized that each peg being advanced must first be brought into contact with the elastic band, before the player counts the holes in his column that his peg must be moved.

The rules of the game will likely involve the player endeavoring to move the elastic band around the second elastic band suspension means being responsible for stretching the band without breaking same, and having to pull a break card if the band does break during such procedure.

With reference to other figures of drawing, in FIG. 2 is an example of the stretch of the elastic band around the suspension means at the beginning or first end of the board, and in this instance being in contact with two of the pegs during play of the game. In FIG. 3 is an example of the elastic band having stretched far enough during play as to also extend around the suspension means located at the opposite or second end of the board, with one of the pegs in play being in the process of starting back toward the beginning or first end of the board;

In FIG. 4 is an example of the events that may transpire if an elastic band of substantial length is used, for in this instance, one of the pegs has traveled to the second end of the board and back without the elastic band having broken, and this peg of one of the players is now in the process of making a second start from the first end of the board.

FIG. 5 is a view of the stacks of stretch cards and break cards that may be used during play of this game.

Although I obviously am not to be limited to such dimensions, one exemplary game board utilizing my invention had the following dimensions:

Length: Approximately 12 inches
Width: Approximately $5\frac{1}{2}$ inches
Holes: On $\frac{1}{2}''$ centers
Hole diameter: 5/32"
Hole pattern: $10\times20$, total 200 holes
Posts: $\frac{3}{4}''$ high and $\frac{1}{4}''$ diameter Quite obviously, a wide selection of elastic bands can be kept on hand, with some of such being of a length as not to break before several trips between the ends of the board.

I also may elect to eliminate the numbers from the stretch cards specifying how many holes a peg must be moved, and to use a roll of a die to determine the number of holes the player must move his or her peg.

I claim:

1. A game for at least two players in a type of contest in which each player strives to avoid breaking a stretched elastic band during his or her turn, the game comprising an elongate game board, said game board utilizing a number of holes arrayed in a series of essentially parallel columns, which columns extend for a substantial portion of the length of the board, each of said holes being designed to receive therein a peg representing each player, elastic band suspension means adjacent one end of said elongate game board, around which an elastic band is mounted, said elastic band having sufficient elasticity as to permit it to be stretched around two or more pegs placed in holes of respective columns, said elastic band continuing to be stretched to a greater and greater extent as the players' pegs are moved away from said elastic band suspension means further down their respective columns and random means for determining the amount of movement of the players' pegs.

2. A game for at least two players engaged in a contest in which each player strives to avoid breaking a stretched elastic band during his or her turn, the game comprising an elongate game board, said game board utilizing a number of blind holes disposed in an equally spaced manner in each of a series of essentially parallel columns, which columns extend for a substantial portion of the length of the board, said holes being of a depth sufficient to receive therein a peg representing each player, elastic band suspension means adjacent one end of said elongate game board, around which an elastic band is mounted, said elastic band having sufficient elasticity as to permit it to be stretched around two or more pegs placed in holes of respective columns, said elastic band continuing to be stretched to a greater and greater extent as the players' pegs are moved further down their respective columns in a first direction away from said elastic band suspension means, with the loser in each phase of the game being that person causing the elastic band to break while he or she is endeavoring to move his or her peg to a hole further away from said fixed elastic band suspension means and random means for determining the amount of movement of the players' pegs.

3. The game board as recited in claim 2 wherein said elastic band suspension means is a pair of spaced apart posts disposed adjacent one end of said board, and said elastic band is an intact rubber band stretched between said posts.

4. The game board as recited in claim 2 wherein the holes in said columns are also aligned in rows extending widthwise across said board.

5. The game board as recited in claim 2 wherein additional suspension means are also affixed at the opposite or second end of said board, so that said elastic band, if it has not broken during the time the pegs have moved all the way to said opposite end of said board, can then be wrapped around said additional fixed suspension means, to be still further stretched as the pegs representing each player are then to be moved along their respective columns in the return or second direction.

* * * * *